US005346580A

United States Patent [19]

Elges et al.

[11] Patent Number: 5,346,580

[45] Date of Patent: Sep. 13, 1994

[54] DEVICE FOR APPLYING A POSSIBLY COATED ADHESIVE FILM TO A SUBSTRATE

[75] Inventors: Johann Elges, Augsburg; Hermann Goldschmidt, Bobingen, both of Fed. Rep. of Germany

[73] Assignee: Citius Buerotechnik GmbH, Gerstofen, Fed. Rep. of Germany

[21] Appl. No.: 80,751

[22] Filed: Jun. 22, 1993

[30] Foreign Application Priority Data

Jun. 25, 1992 [DE] Fed. Rep. of Germany ..... 4220843

[51] Int. Cl.[5] ..... B32B 31/00

[52] U.S. Cl. ..... 156/540; 156/579; 156/577

[58] Field of Search ..... 156/523, 577, 579, 540, 156/584; 221/73

[56] References Cited

U.S. PATENT DOCUMENTS

| | | | |
|---|---|---|---|
| 3,785,901 | 1/1974 | Fritzinger | 156/579 X |
| 4,849,064 | 7/1989 | Manusch et al. | 156/577 |
| 4,851,076 | 7/1989 | Manush et al. | 156/577 |
| 5,049,229 | 9/1991 | Czech | 156/577 |

*Primary Examiner*—Mark Osele

*Attorney, Agent, or Firm*—Flynn, Thiel, Boutell & Tanis

[57] ABSTRACT

The device for applying a coated plastics film to a substrate, consists of a housing (1) and an interchangeable cassette (4) which comprises a supply spool (5), an empty spool (8) which can be driven from this and an application tongue (7). The housing (1) has a through opening for the application tongue at its front end (1*a*) and a loading opening (3) for introducing and removing the cassette (4) at its opposite, rear end. The cassette (4) can be slid into the housing (1) from its loading opening (3) to the through opening in a straight line. A compression spring extending in the direction of movement of the cassette (4) is arranged in the housing (1), into contact with which comes a projection on the cassette (4), before the application tongue (7) has reached the through opening. A spring-loaded detent device (13, 15, 16*a*) with a press-button (14) is provided between the cassette (4) and the housing (1), by means of which the cassette (4) can be locked in its working position relative to the housing (1), and which can be released by actuation of the push-button (14), so that the cassette (4) is automatically pushed back into its position of non-use under the action of the compression spring, in which position the tip of the application tongue (7) lies within the housing (1).

11 Claims, 3 Drawing Sheets

DEVICE FOR APPLYING A POSSIBLY COATED ADHESIVE FILM TO A SUBSTRATE

Figure 1:
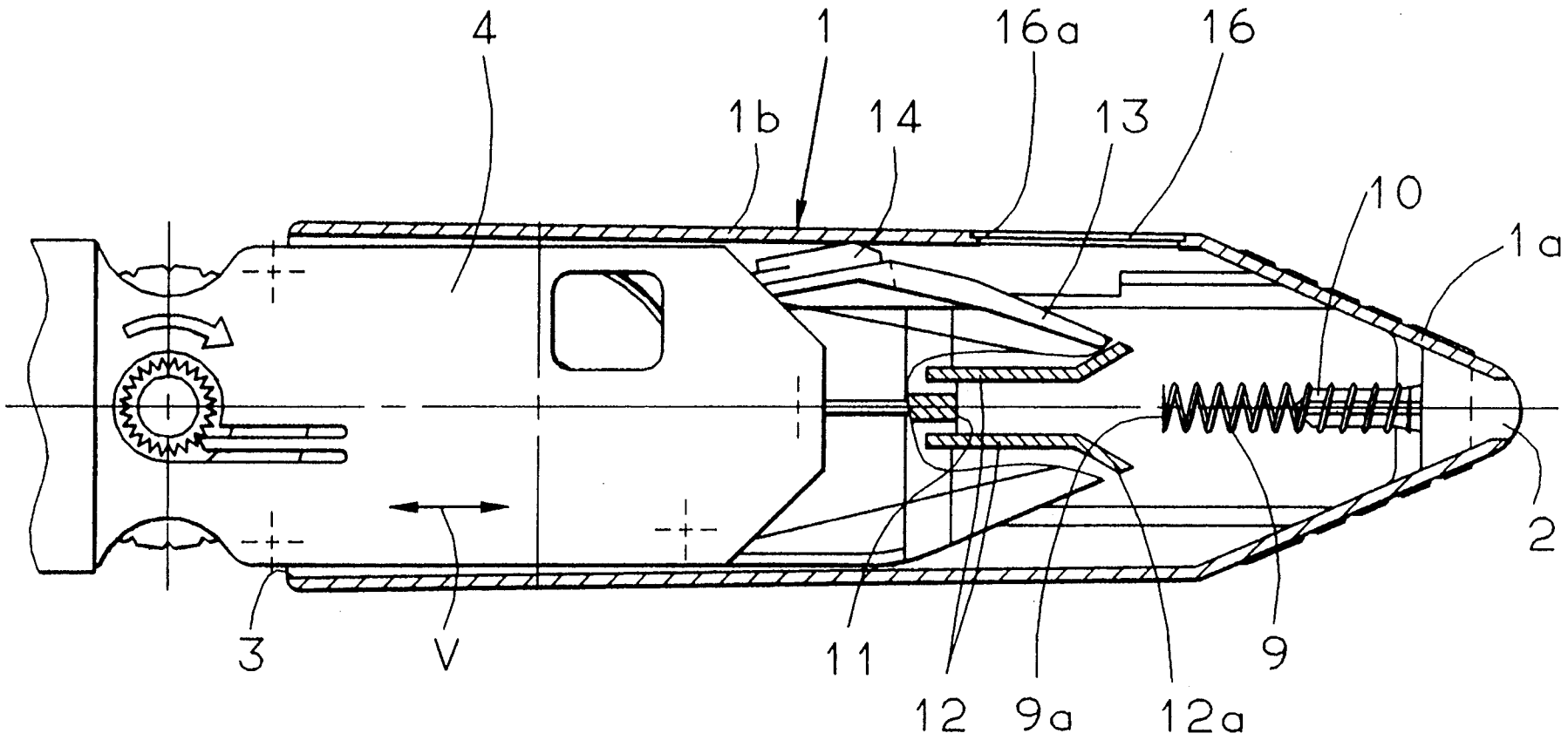

This invention relates to a device for applying a possibly coated plastics film to a substrate, consisting of a housing and an interchangeable cassette fitting in this housing and which comprises a supply spool, from which a backing strip provided with the adhesive film can be unrolled, an empty spool which can be driven from the supply roll through a drive device for winding up the empty backing strip, and an application tongue, over which the backing strip coming from the supply spool is fed, wherein the housing has a through opening for the application tongue at its front end and a loading opening for introducing and removing the cassette at its opposite, rear end.

In one known device of this kind (DE 3 900 156 A1) the housing consists of two parts, namely the housing proper and a flap forming a sidewall and the rear wall of the housing and which is pivotally connected to the housing. The flap has retaining means for the cassette. To change the cassette the flap can be opened and the used cassette exchanged for a new one. During the closure of the flap, the application tongue of the cassette is pushed through the through opening in the housing and then remains constantly in this working position until the next change of cassette. The flap closes the loading opening. Since the application tongue projects all the time from the housing, there is the danger that, when the device is put down, the application tongue and the adhesive film extending over the application tongue will come into contact with other articles and will therefore be damaged or partially stripped off the backing strip. This is particularly disadvantageous if the adhesive film has a white coating for covering written symbols, parts of drawings and the like. The damaged adhesive film then no longer has a straight tearing edge and the obliteration appears frayed at the beginning. If the adhesive film comes into contact with clothing, e.g. when putting the device into a jacket pocket, this can be made dirty by the coating. Furthermore, in the known device the change of cassette is troublesome since the flap must firstly be opened for this and, after removing the used cassette, a new cassette has to be fitted between the retaining means. If the necessary care is not taken in this, parts of the cassette or the housing can be damaged on closing the flap. Finally, in the known device, increased production costs result from the two-pan housing. Thus an additional mold is needed for making the flap and the flap must moreover be pivotally attached to the housing during assembly.

The invention is therefore based on the object of providing a device for applying a possibly coated adhesive film to a substrate, of the kind initially referred to, in which damage to the adhesive film when not in use and dirtying e.g. the clothing of the user are prevented and which moreover facilitates still easier cassette changing.

This is achieved according to the invention in that the cassette can be slid into the housing from its loading opening to the through opening in a straight line, in that a compression spring extending in the direction of movement of the cassette is arranged in the housing and is contacted by a projection on the cassette, before the application tongue has reached the through opening, and in that a spring-loaded detent device with a push-button is provided, acting between the cassette and the housing, by means of which the cassette pushed forward against the spring force of the compression spring in the housing into its working position, in which the application tongue projects through the through opening out of the housing, can be locked relative to the housing, and which can be released by actuating the push-button, so that the cassette is automatically pushed back into its position of non-use under the action of the compression spring, in which position the tip of the application tongue lies within the housing.

The invention is thus based on the idea of only letting the application tongue project from the housing so long as the device is in use for the application of an adhesive film. When not in use however, the tip of the application tongue will be protected within the housing. This can be achieved in a simple manner with the device according to the invention by actuation of the push-button. If this is pressed after completing an application of the adhesive film, the prestressed spring can act and pushes the cassette to the rear some way into the housing, until the tip of the application tongue is located inside the housing. In this manner, in the position of non-use of the device, the adhesive film fed over the application tongue is protected within the housing. It cannot be damaged and also cannot be inadvertenly released, so that contamination of clothing of the user is ruled out. The cassette change is particularly simple with the novel device, since this merely has to be pushed in a straight line into the housing or be pulled out of the same. The detent device can be so formed for this that it does not only hold the cassette in the working position but also releases the cassette for cassette change with suitable actuation of the push-button.

An especially advantageous embodiment of the invention consists in that the cassette consists of plastics material and comprises on one side a spring tongue unitary therewith, on whose free end are arranged the push-button and a detent acting in the working position against a counter detent of the housing, and in that the housing has a slot opening for the push-button in one sidewall.

Since in this embodiment, the spring tongue and also the push-button and the detent form a unitary part with the cassette, they can be made in simple manner during production of the cassette by the injection molding method and do not require any kind of additional expense of manufacture or assembly. The detent device itself is formed by parts of the housing and the spring tongue and likewise requires no additional expense of manufacture or assembly.

Figure 2:
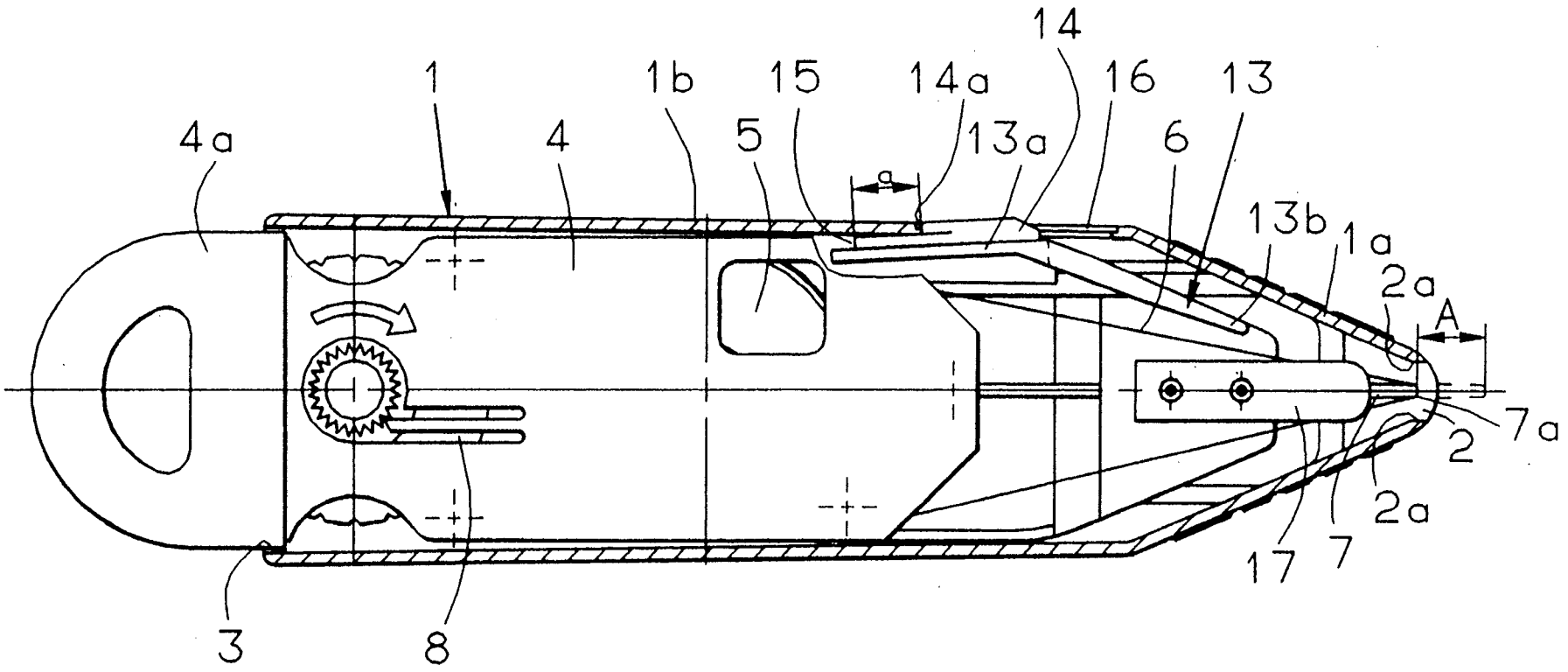
Figure 3:
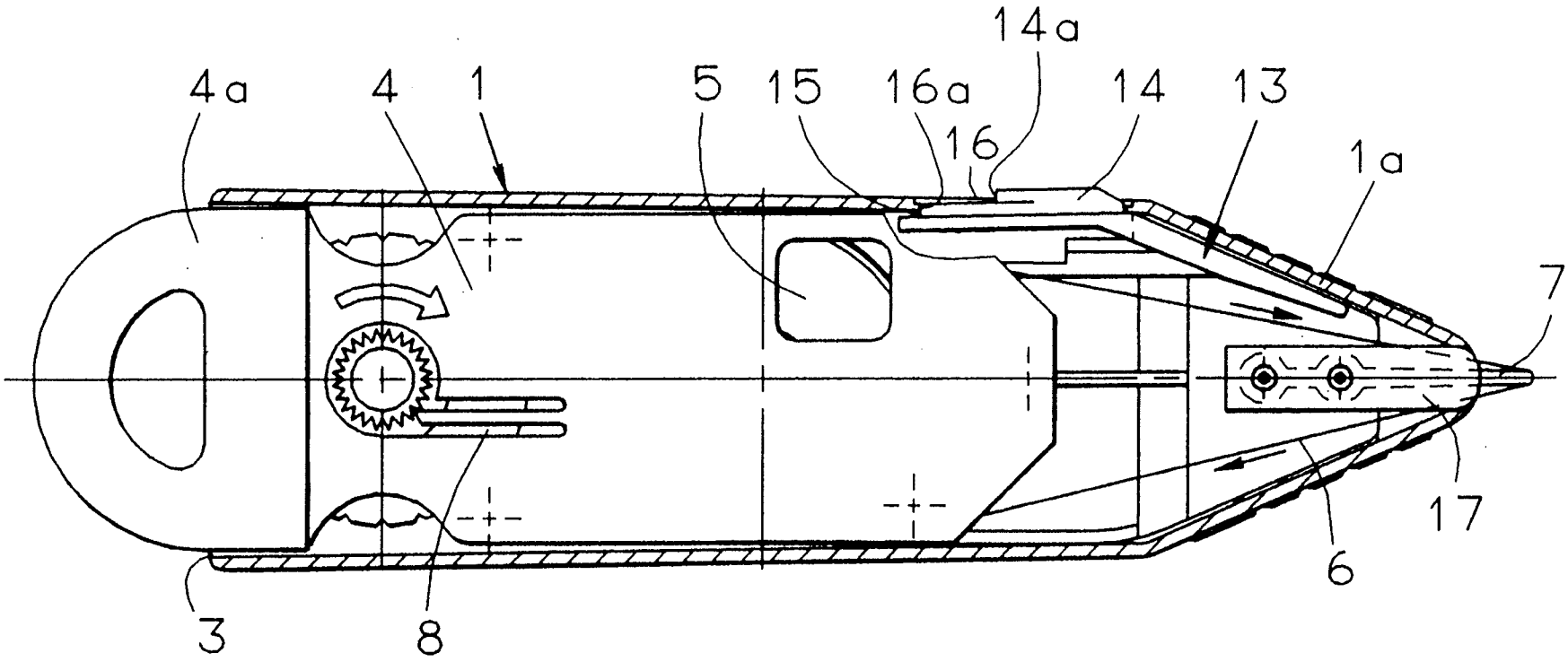

Further advantageous embodiments of the invention are characterized in the other dependent claims. The invention will be explained in more detail below with reference to an embodiment shown in the drawings, in which:

FIGS. 1 to 3 are respective longitudinal sections of the device in cassette change, non-use and working positions.

The device comprises a housing 1, which advantageously consists of a single plastics part. This housing is provided at its one, front end with a through opening 2 and comprises a loading opening 3 at its other, rear end. The housing 1 is advantageously substantially rectangular in plan and its front end tapers in triangular manner to the through opening 2. The housing is formed like a pencil and is shown in the drawing approximately double size.

A cassette 4 is arranged in the housing 1 and can be inserted into the loading opening 3 or be withdrawn therefrom during cassette change. The cassette 4 is movable in the housing 1 from the loading opening 3 to the through opening 2 in a straight line. It comprises a supply spool 5, on which is wound a backing strip 6 coated with an adhesive film. The adhesive film itself can be provided with a white or otherwise pigmented layer to obliterate written symbols or parts of drawings. The backing strip 6 is fed from the supply spool over an application tongue 7 and thence to an empty spool 8 which serves for winding up the empty backing strip. In between the supply spool 5 and the empty spool 8 there is provided a drive device, not shown, by means of which the empty spool 8 can be driven from the supply spool 5.

In the vicinity of the front end 1*a* of the housing 1 there is arranged a compression spring 9 extending in the direction of movement V on one side of the cassette. To retain the compression spring 9 in the housing a receiving peg 10 is provided, being formed in one piece with the housing 1 and on to which the compression spring 9 is pushed so as to grip. Furthermore, a side projection 11 is provided on the cassette 4, on which the free end 9*a* of the compression spring 9 bears in the working position and the position of non-use (FIGS. 2 and 3). The cassette 4 can further comprise guide strips 12 provided with lead-in bevels 12*a* to guide the compression spring 9.

A spring tongue 13 is further arranged on the one side of the cassette 4 and on the free end 13*a* of the tongue there are provided a push-button 14 and a detent 15. The other end 13*b* of the spring tongue 13 is fixedly connected to the cassette 4. The spring tongue 13 is formed in one piece with the cassette 4 consisting of plastics material. The detent 15 is offset to the rear relative to the push-button 14. The spacing a of the detent from the rear edge 14*a* of the push-button 14 amounts to the stroke of movement A of the cassette between the working position (FIG. 3) and the position of non-use (FIG. 2).

The housing 1 further comprises a slot opening 16 for the push-button 14 in one sidewall 1*b*. The rear end surface 16*a* of this opening 16 forms the counter-detent for the detent 15 and serves also as the abutment surface for the rear edge 14*a* of the push-button. To change the cassette the push-button 14 can be pushed completely into the housing 1, so that its abutment against the rear end surface 16*a* of the slot opening 16 is lost.

The application tongue 7 is advantageously arranged on a carrier 17, which projects in the working position, as shown in FIG. 3, into the through opening 2 and bears on its edges 2*a*. In this way the application tongue 7 is supported securely in the housing 1 through the carrier 17.

The manner of operation of the device is as follows:

It is assumed that, in accordance with FIG. 1, the housing is being fitted with a new cassette 4. This is pushed in through the loading opening 3 from left to right, in a straight line. The free end 9*a* of the compression spring 9 then comes into abutment with the projection 11, so that a certain resistance results in the pushing in of the cassette. When the push-button 14 has reached the region of the slot opening 16, it is pushed outwardly through this opening 16 under the action of the spring tongue 13. If the cassette is now released, the compression spring 9 pushes the cassette to the rear and the rear edge 14*a* comes into abutment with the end surface 16*a* of the slot opening 16. The cassette is thus held in its position of non-use shown in FIG. 2. To use the device, the rear end 4*a* of the cassette 4 projecting out of the housing 1 is pushed, so that the cassette is pushed to the right into its working position shown in FIG. 3. As soon as this is reached, the detent 15 clicks into engagement with the rear end surface 16*a* of the opening 16 and the cassette 4 is thus fixed in its working position. The application tongue projects out of the through opening 2. The application tongue can then be pressed on to a document and be moved over the document either by pushing or pulling, whereby the adhesive film adhering to the backing strip 6 is released therefrom and is pressed on to the document by the application tongue 7. When the device is no longer being used, it is only necessary to press the push-button 14 gently, whereby the engagement between the detent 15 and the end surface 16*a* is released. The cassette 4 is then automatically pushed by the compression spring 9 into the position of non-use shown in FIG. 2, until the rear edge 14*a* of the push-button 14 comes into engagement with the end surface 16*a*. The cassette moves through the stroke A relative to the housing 1. In the position of non-use the tip 7*a* of the application tongue 7 lies within the housing 1. The adhesive film is therefore protected against inadvertent contact and it also cannot contaminate articles of clothing or the like. If the cassette is to be changed, the push-button 14 is pressed again in the position of non-use. Its rear edge 14*a* then loses its engagement with the end surface 16*a* and the cassette is pushed a small amount to the left under the action of the compression spring 9. The cassette can then easily be taken out of the housing 1 by pulling its rear end 4*a*. The rear end 4*a* closes the loading opening 3 in the position of non-use and in the working position.

The housing 1 and the cassette 4 advantageously have a rectangular cross-section, since this gives an especially space-saving, flat shape.

We claim:

1. A device for applying an adhesive film to a substrate, consisting of a housing and an interchangeable cassette fitting in this housing and which comprises a supply spool, from which a backing strip provided with the adhesive film can be unrolled, an empty spool which can be driven from the supply roll through a drive device, for winding up the empty backing strip, and an application tongue, over which the backing strip coming from the supply spool is fed, wherein the housing has a through opening for the application tongue at its front end and a loading opening for introducing and removing the cassette at its opposite, rear end, wherein the cassette (4) can be slid into the housing (1) from its loading opening (3) to the through opening (2) in a straight line, wherein a compression spring (9) extending in the direction of movement of the cassette (4) is arranged in the housing (1) and is contacted by a projection (11) on the cassette, before the application tongue (7) has reached the through opening (2), and wherein a spring-loaded detent device (13, 15, 16*a*) with a push-button (14) is provided, acting between the cassette (4) and the housing (1), by means of which the cassette (4) pushed forward against the spring force of the compression spring (9) in the housing (1) into its working position, in which the application tongue (7) projects through the through opening (2) out of the housing (1), can be locked relative to the housing, and which can be released by actuating the push-button (14), so that the cassette (4) is automatically pushed back into its position of non-use under the action of the compression spring (9), in which position the tip (*7a*) of the application tongue (7) lies within the housing (1).

2. The device according to claim 1, wherein the cassette (4) consists of plastics material and comprises on one side a spring tongue (13) unitary therewith, on whose free end (13*a*) are arranged the push-button (14) and a detent (15) acting in the working position against a counter detent (16*a*) of the housing (1), and wherein the housing (1) has a slot opening (16) for the push-button (14) in one sidewall (1*b*).

3. The device according to claim 2, wherein the detent (15) is inwardly offset relative to the push-button (14) and wherein the rear end surface (16*a*) of the slot opening (16) forms the counter detent.

4. The device according to claim 3, wherein the spacing (a) of the detent (15) from the rear edge (14*a*) of the push-button (14) corresponds to the stroke (A) of the cassette (4) between the working position and a position of non-use and wherein the rear edge (14*a*) of the push-button (14) in the position of non-use bears on the rear end surface (16*a*) of the slot opening (16).

5. The device according to claim 2, wherein the push-button (14) can be pushed completely into the housing (1) for cassette change, so that it loses its abutment on the rear end surface (16*a*) of the slot opening (16).

6. The device according to claim 1, wherein a receiving peg (10) for the compression spring (9) is provided at the front end (1*a*) of the housing (1), on to which the compression spring is pushed so as to grip.

7. The device according to claim 1, wherein the application tongue (7) is arranged on a carrier (17) which projects in the working position into the through opening (2) and abuts the edges (2*a*) thereof.

8. The device according to claim 1, wherein the housing (1) is substantially rectangular in plan view and is tapered off in triangular manner at the front end (1*a*) towards the through opening (2).

9. The device according to claim 8, wherein the housing (1) and the cassette (4) have a substantially rectangular cross-section.

10. The device according to claim 8, wherein the housing (1) consists of a single plastics part.

11. The device according to claim 10, wherein the rear end (4*a*) of the cassette (4) closes the loading opening (3) in the working position and the position of non-use.

* * * * *